US010125757B2

(12) United States Patent
Santa

(10) Patent No.: US 10,125,757 B2
(45) Date of Patent: Nov. 13, 2018

(54) VALVE FOR A DIAPHRAGM PUMP

(71) Applicant: Joe Santa & Associates Pty Limited, Toronto West (AU)

(72) Inventor: David Luiz Santa, Jewells (AU)

(73) Assignee: Joe Santa & Associates PTY Limited, Toronto West, New South Wales (AU)

( * ) Notice: Subject to any disclaimer, the term of this patent is extended or adjusted under 35 U.S.C. 154(b) by 0 days.

(21) Appl. No.: 14/773,025

(22) PCT Filed: Feb. 20, 2014

(86) PCT No.: PCT/AU2014/000151
§ 371 (c)(1),
(2) Date: Sep. 4, 2015

(87) PCT Pub. No.: WO2014/183149
PCT Pub. Date: Nov. 20, 2014

(65) Prior Publication Data

US 2016/0025087 A1 Jan. 28, 2016

(30) Foreign Application Priority Data

May 14, 2013 (AU) ..... 2013901693

(51) Int. Cl.
*F04B 43/073* (2006.01)
*F04B 45/053* (2006.01)
*F04B 53/00* (2006.01)

(52) U.S. Cl.
CPC ..... *F04B 43/0736* (2013.01); *F04B 43/073* (2013.01); *F04B 45/0536* (2013.01); *F04B 53/004* (2013.01)

(58) Field of Classification Search
CPC ..... F04B 43/0736
(Continued)

(56) References Cited

U.S. PATENT DOCUMENTS 3,548,716 A * 12/1970 Rayl ..... F01L 25/063 417/393
3,838,946 A * 10/1974 Schall ..... F01L 15/08 417/393
(Continued)

FOREIGN PATENT DOCUMENTS

CN 1099103 A 2/1995
GB 2140097 A 11/1984
(Continued)

OTHER PUBLICATIONS

International Search Report dated Apr. 22, 2014, from International Application No. PCT/AU2014/000151 (3 pages).
(Continued)

*Primary Examiner* — Peter J Bertheaud
(74) *Attorney, Agent, or Firm* — Kilpatrick Townsend & Stockton LLP

(57) ABSTRACT

A diaphragm pump (10) including a body (11) that provides a pair of opposed pump chambers (12) and (13). Mounted in the body (11) is a piston assembly (14) providing a pair of pistons (15) joined by a transverse piston rod (16) so that the pistons (15) are caused to reciprocate in unison linearly in the direction (17) along the axis (18). Each piston (15) includes a diaphragm (22) that provides a first sub-chamber (23) and a second sub-chamber (24). A working fluid (liquid or gas) under pressure is alternately delivered to the sub-chambers (23) to cause the piston assembly (14) to reciprocate. A valve (25) is operated to co-ordinate delivery of the fluid under pressure or alternately to the first sub-chambers (23).

7 Claims, 10 Drawing Sheets

(58) Field of Classification Search
USPC ..... 417/395
See application file for complete search history.

(56) References Cited

U.S. PATENT DOCUMENTS

| | | | | | |
|---|---|---|---|---|---|
| 5,161,450 | A * | 11/1992 | Ishikawa | F01B 17/02 | 137/339 |
| 5,326,234 | A * | 7/1994 | Versaw | F04B 43/0736 | 417/393 |
| 5,368,452 | A | 11/1994 | Johnson et al. | | |
| 5,564,911 | A | 10/1996 | Santa | | |
| 2011/0103984 | A1 | 5/2011 | Santa | | |
| 2011/0142692 | A1 | 6/2011 | Roseberry | | |
| 2013/0058802 | A1* | 3/2013 | Roman | F04B 45/043 | 417/312 |

FOREIGN PATENT DOCUMENTS

| | | | |
|---|---|---|---|
| JP | 2007-120446 | A | 5/2007 |
| WO | 2009/137862 | A1 | 11/2009 |

OTHER PUBLICATIONS

Chinese Official Action dated Nov. 17, 2016 from corresponding Chinese Patent Application No. 201480027802X with English translation (eight pages).

* cited by examiner

VALVE FOR A DIAPHRAGM PUMP

CROSS-REFERENCE TO RELATED APPLICATIONS

This application is a U.S. National Phase of International Application No. PCT/AU2014/000151, filed Feb. 20, 2014, which claims priority to Australian Patent Application No. 2013901693, filed May 14, 2013, the disclosures of which are incorporated by reference herein.

FIELD

The present invention relates to valves and more particularly but not exclusively to valves for diaphragm pumps that are operated by a working fluid under pressure such as air.

BACKGROUND

Diaphragm pumps include a pump chamber that is divided by a piston or diaphragm so as to provide a first sub-chamber that receives a working fluid (liquid or gas) under pressure, and a second sub-chamber that receives the fluid being pumped. A working fluid under pressure is delivered to the first sub-chamber to cause reciprocation of the piston and diaphragm to vary the volume of the second sub-chamber and thereby pump a fluid therethrough. These diaphragm pumps have an inlet and an outlet that communicate with the second sub-chamber via one-way valves so that the fluid being pumped passes in a predetermined direction through the pump. A first manifold joins the inlet with the second sub-chamber while a second manifold joins the second sub-chamber is with the outlet.

Described in International Patent Application PCT/AU2009000199 (WO 2009/137862 A1) is a diaphragm pump that is operated by air under pressure. The pump includes a valve that provides and coordinates the delivery and exhaust of air with respect to the first sub-chamber. The exhaust air passes through the valve and is delivered to a muffler.

Efficiency of the above described pump is diminished due to resistance of air flow downstream from the valve.

OBJECT

It is the object of the present invention to overcome or substantially ameliorate at least one of the above disadvantages.

SUMMARY

There is disclosed herein a pump having:

a pump body providing a pump chamber;

a piston movably mounted in the body for reciprocation relative to the body;

a diaphragm sealingly connecting the piston to the body so as to divide said chamber into a first sub-chamber and a second sub-chamber:

first ducting, said first ducting being in communication with said first sub-chamber to provide for the flow of a pumped fluid to and from said first sub-chamber;

second ducting, said second ducting being in communication with said second sub-chamber to provide for the flow of a working fluid to and from said second chamber to cause the reciprocation of said piston;

a valve to provide for the delivery and exhaust of the working fluid with respect to the second sub-chamber, the valve including:

a valve body having a delivery duct, a first exhaust duct and a second exhaust duct; and a movable valve element mounted in and movable with respect to the body to provide for the timed connection of the delivery duct with the second sub-chamber to deliver the working fluid thereto, and the timed connection of the first and second exhaust ducts with the second sub-chamber to duct the working fluid from the second sub-chamber.

Preferably, the pump includes a muffler through which the working fluid passes and to which the first exhaust duct is connected so as to deliver the working fluid to the muffler.

Preferably, the second exhaust duct extends to the exterior of the valve body wherefrom the working fluid is exhausted directly to atmosphere.

Preferably, the valve is a spool valve, with the movable valve element being a spool, with the spool moved axially between a first position connecting the second sub-chamber to a supply of the working fluid under pressure, and a second position connecting the second sub-chamber with the first and second exhaust ducts.

Preferably, the pump chamber is a first chamber with the body having a second pump chamber, the piston is a first piston, with the pump including a second piston, the second piston also being mounted in the body for reciprocation relative to the body in a direction opposite the first piston, the diaphragm is a first diaphragm, and the pump includes a second diaphragm sealingly connecting the second piston to the body so as to divide the second chamber into a third sub-chamber and a fourth sub-chamber; and wherein the pump further includes:

fourth ducting, the fourth ducting being in communication with the third sub-chamber to provide for the flow of pump fluid to and from the third sub-chamber, fifth ducting, the fifth ducting being in communication with the fourth sub-chamber to provide for the flow of the working fluid to and from the fourth sub-chamber to cause reciprocation of the second piston, with the valve providing for the delivery and exhaust of the working fluid with respect to the fourth sub-chamber, by the timed connection of the delivery duct to the fourth sub-chamber and the connection of the first and second exhaust ducts with the fourth sub-chamber.

Preferably, the working fluid is air.

BRIEF DESCRIPTION OF DRAWINGS

A preferred form of the present invention will now be described, by way of an example only, with reference to the accompanying drawings wherein.

DESCRIPTION OF EMBODIMENTS

Figure 1:
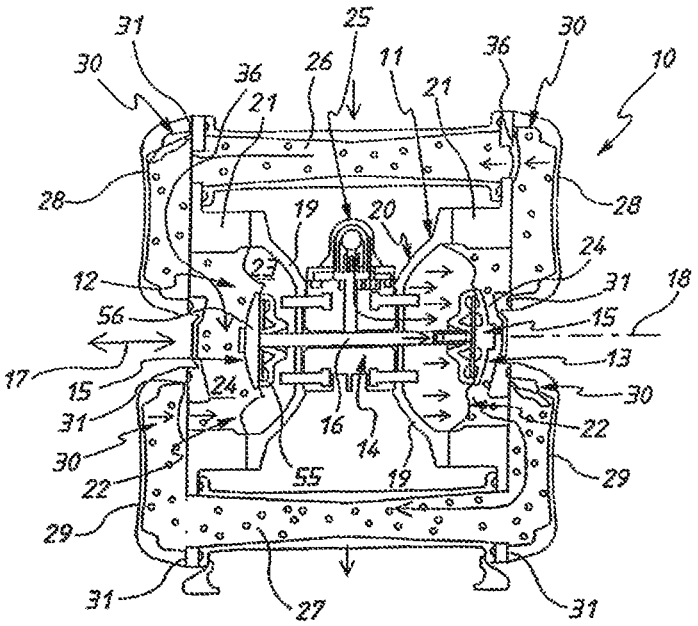
FIG. 1 is a schematic sectioned side elevation of a diaphragm pump.
Figure 2:
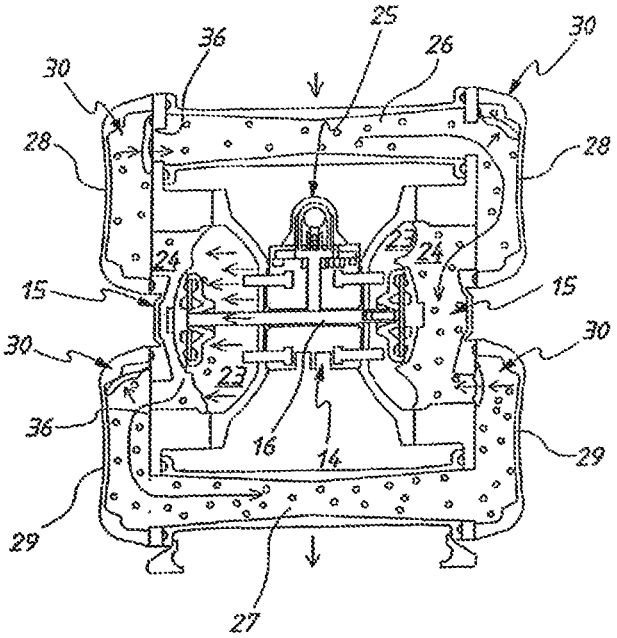
FIG. 2 is a schematic further sectioned side elevation of the pump of FIG. 1.

In the accompanying drawings, there is schematically depicted a diaphragm pump 10. The pump 10 includes a pump body 11 that provides a pair of opposed pump chambers 12 and 13. Mounted in the body 11 is a piston assembly 14 providing a pair of pistons 15 joined by a transverse piston rod 16 so that the pistons 15 are caused to reciprocate in unison linearly in the direction 17 along the axis 18. The piston rod 16 and pistons 15 have as their longitudinal axis the longitudinal axis 18. The body 11 includes a base 20 providing a pair of cup portions 19. Secured to each cup portion 19 is a sleeve 21, with the cup portions 19 and associated sleeves 19 cooperating to provide the chambers 12 and 13.

The piston rod 16 is slidably mounted in the cup portions 19.

Fixed to each piston 15 is a diaphragm 22 that together with the associated piston 15 divides the respective chamber 12 or 13 into a first sub-chamber 23 and a second sub-chamber 24. A working fluid (liquid or gas) under pressure is alternately delivered to the sub-chambers 23 to cause reciprocation of the piston assembly 14. Accordingly the pump 10 could be hydraulically or pneumatically driven.

Schematically depicted is a control valve 25 and associated ducting that delivers the working fluid to the sub-chambers 23 and provides for drainage of the working fluid therefrom as the chambers 23 are varied in volume.

The pump 10 has an inlet 26 to which a fluid being pumped is delivered, and an outlet 27 to which the fluid being pumped is delivered under pressure by the pump 10. The inlet 26 communicates with both sub-chambers 24 while the outlet 27 also communicates with both sub-chambers 24. More particularly, the inlet 26 is joined to the sub-chamber 24 by a manifold 28. While each outlet 27 is joined to the sub-chamber 24 by a manifold 29.

To ensure that the fluid being pumped passes in a predetermined direction through the pump 10 there is provided one-way valves 30.

Figure 3:
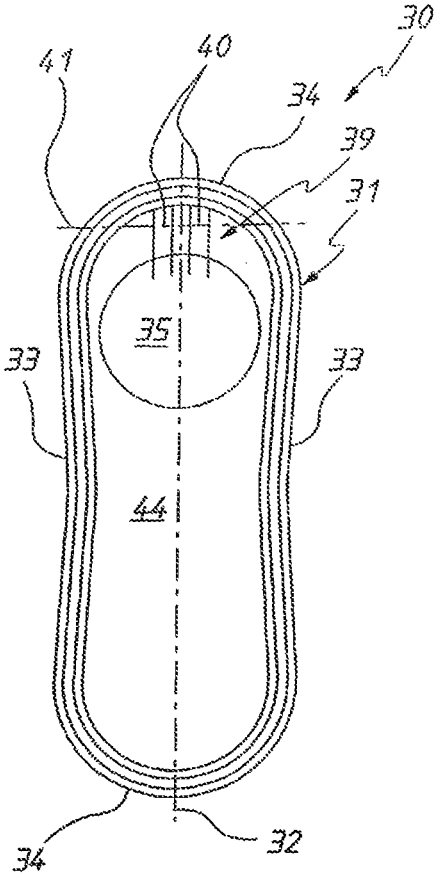
FIG. 3 is a schematic plan view of a valve employed in a pump of FIG. 1.
Figure 4:
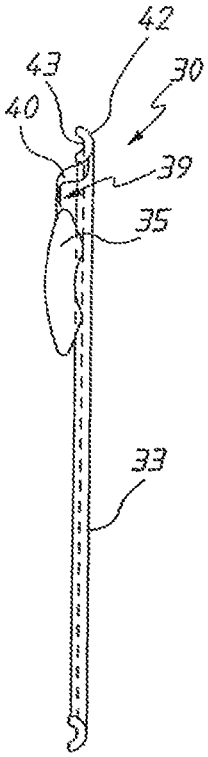
FIG. 4 is a schematic sectioned side elevation of the valve of FIG. 3.
Figure 5:
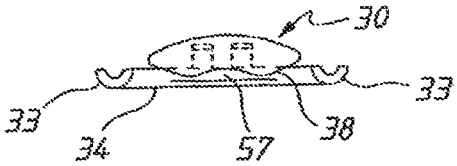
FIG. 5 is a schematic sectioned end elevation of the valve of FIG. 3.

One of the one-way valves 30 is best seen in FIGS. 3 to 5. Each one-way valve 30 is integrally formed of resilient plastics material and provides for the control of fluid being pumped through the valve 10 while also sealingly connecting the associated manifold 28/29 with the body 11. Each valve 30 includes an elongated base 31 that has a longitudinal axis 32. The base 31 has a pair of longitudinally extending side portions 33 that are substantially co-extensive and are transversely spaced relative to the axis 32. Joining the side portions 33 are end portions 34 that are spaced longitudinally relative to the axis 32 and extend generally transverse of the axis 32. Each end portion 34 is generally arcuate in configuration.

The base 31 provides a seal between the associated manifold 28 and sleeve 21.

Each valve 30 further includes a movable valve member 35 that is caused to move relative to an associated valve seat 36 providing a valve opening 37. In particular, each member 35 is caused to move between an opened position providing for flow through the associated valve opening 37, and a closed position preventing flow through the valve opening 37 in the reverse direction.

Each valve member 35 is generally circular in configuration and has an annular convex surface 38 that engages the associated valve seat 36. Generally centrally of the valve member 35 and surrounded by the surface 38 is a depression 57. When the valve member 35 is in an open position, the depression 57 aids in providing a bigger aperture for fluid flow. Each member 35 is attached to an adjacent end portion 34 by a bridge 39. By resilient deformation of the bridge 39 the member 35 is able to move relative to the associated valve seat 36. Each bridge 39 includes a pair of transversely spaced elongated bridge portions 40 that extend generally parallel to the axis 32 and provide for angular movement of the valve member 25 about a transverse axis 41.

Preferably, the base 31 in transverse cross-section is arcuate, and more particularly is of a "C" configuration. Accordingly, the base 33 provides a convex surface 42 and a convex surface 43.

As best seen in FIG. 3 the base 33 is a closed loop surrounding an aperture 44 within which the member 35 is located.

The diaphragm 22 is illustrated in FIGS. 6, 7, 8 and 9.

The diaphragm 22 includes a central base 45 that is of an annular configuration so as to provide a central aperture 46. The base 45 has a plurality of ribs 47 that aid in securing and sealing the diaphragm 22 to the associated piston 15. In particular, the base 45 extends radially from and angularly about the axis 18 and is generally planar. The base 45 is of an annular configuration so that its longitudinal axis is also the axis 18.

The diaphragm 22 has a peripheral portion 48 fixed to the body 20. Extending between the base 45 and periphery 48 is a diaphragm portion 49. The diaphragm portion 49 is also annular and has first radially and angularly extending segments 50 and second radially and angularly extending segments 51. The segments 51 are further displaced from the base 45 in the direction of the axis 18 than the segments 50.

The segments 50 have a greater width 52 than the corresponding width 53 of the segments 51. The segments 50 and 51 are joined by hinge portions 54 that separate the segments 50 and 51. The hinge portions 54 provide for relative movement between the segments 50 and 51 by resilient deformation of the hinge portions 54. This relative movement is provided by resilient deformation of the diaphragm portion 49 adjacent the 5 hinge lines 54.

Figure 6:
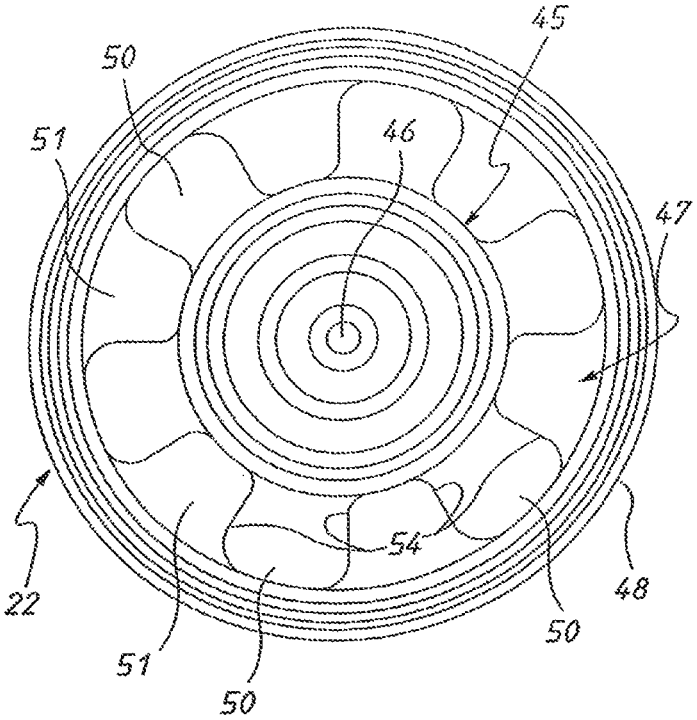
FIG. 6 is a schematic plan view of a diaphragm employed in a pump of FIG. 1.
Figure 7:
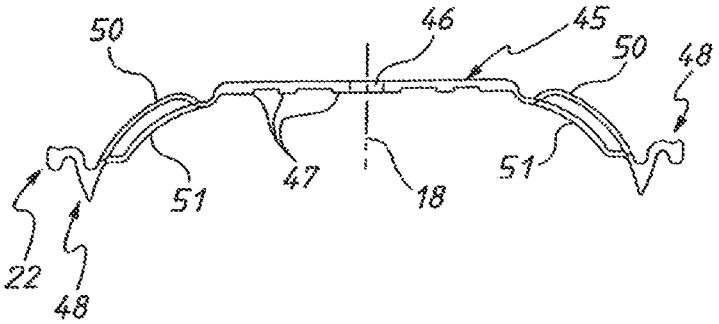
FIG. 7 is a schematic sectioned side elevation of the diaphragm of FIG. 6.
Figure 8:
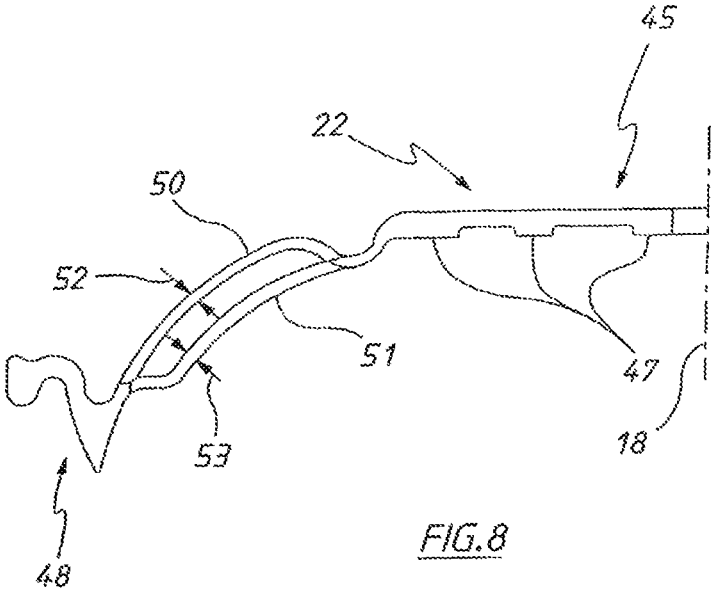
FIG. 8 is a schematic enlarged sectioned elevation of portion of the diaphragm as shown in FIG. 7.
Figure 9:
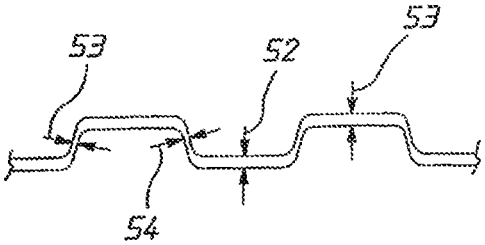
FIG. 9 is a schematic enlarged sectioned elevation of portion of the diaphragm as shown in FIG. 7.
Figure 10:
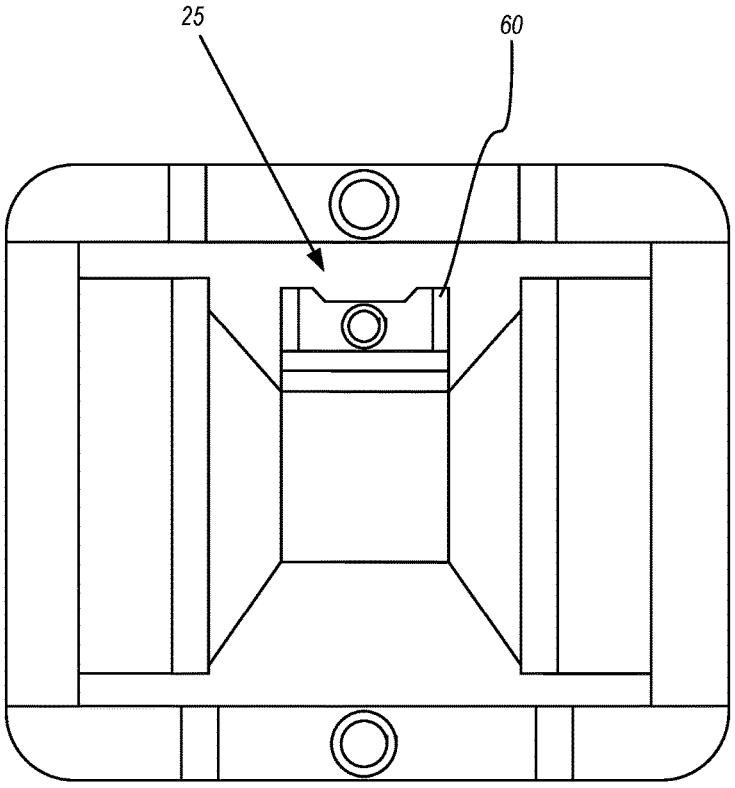
FIG. 10 is a schematic plan view of the pump of FIGS. 1 to 8.
Figure 11:
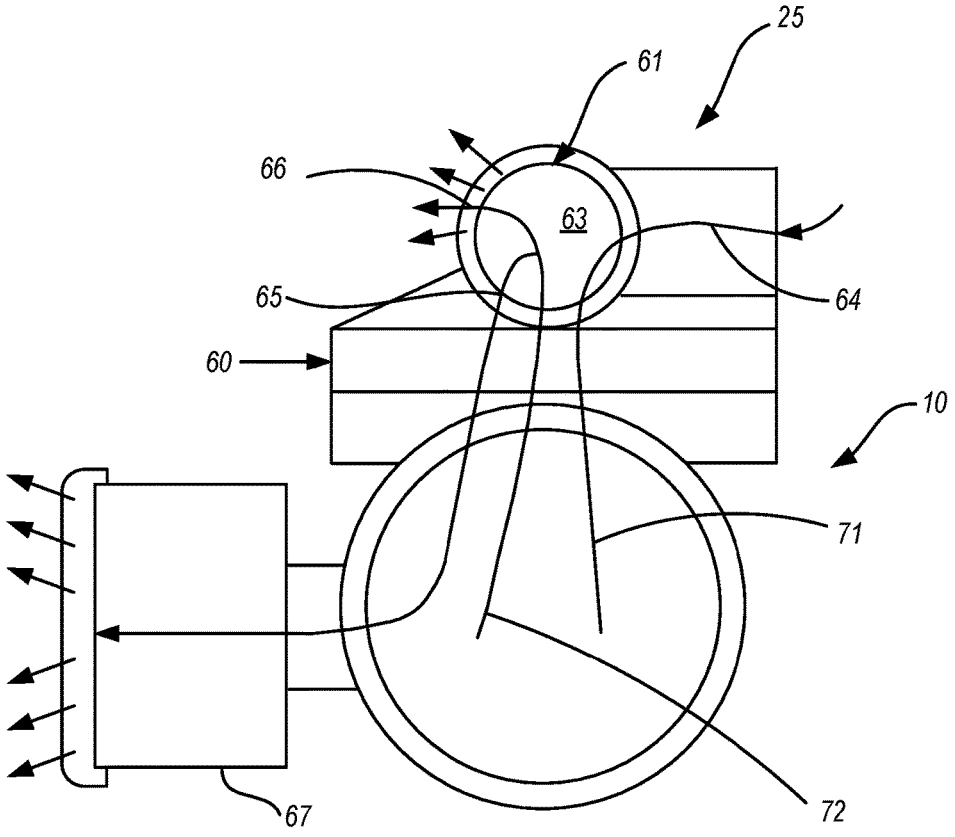
FIG. 11 is a schematic side elevation of the pump having assembly as shown in FIG. 10.
Figure 13:
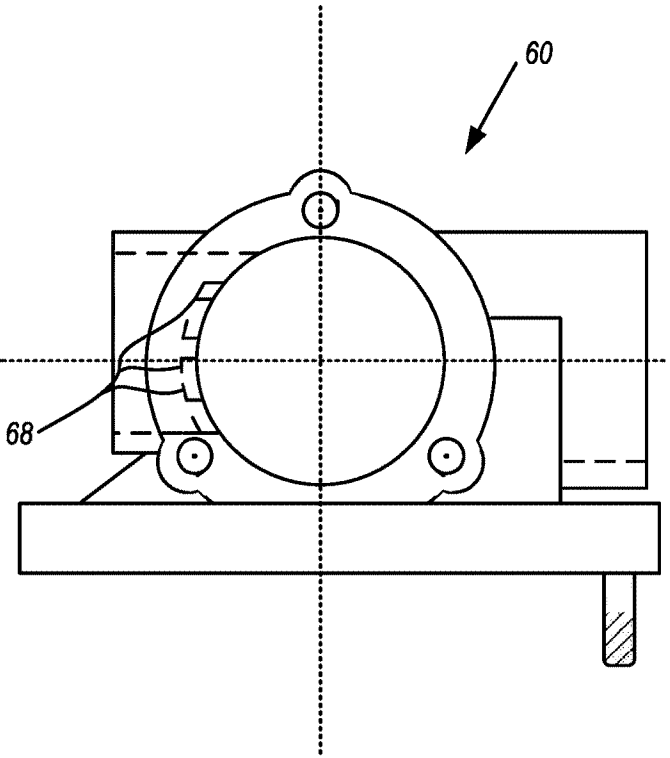
FIG. 13 is a schematic end elevation of the valve body of FIG. 12.
Figure 12:
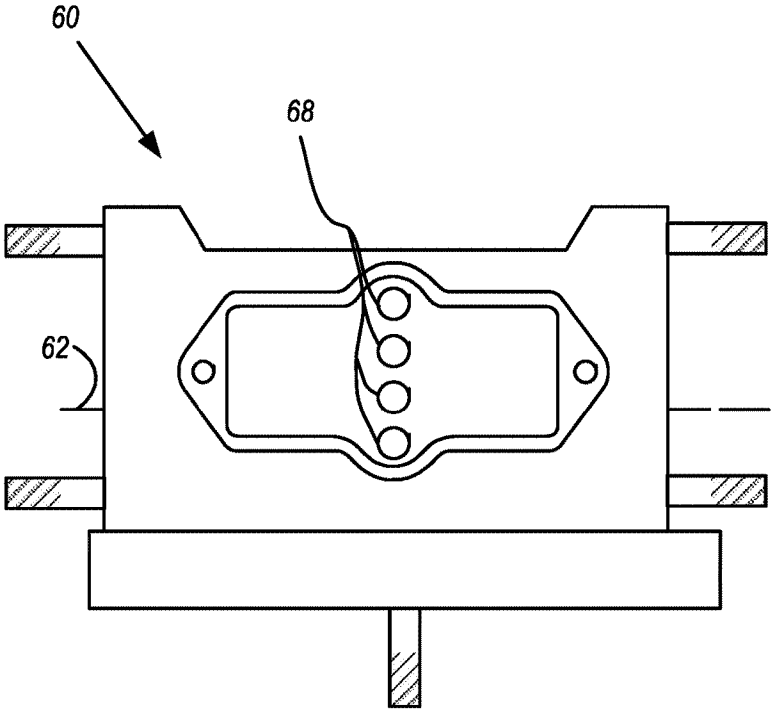
FIG. 12 is a schematic plan view of a valve housing employed in the pump as shown in FIGS. 10 and 11.
Figure 14:
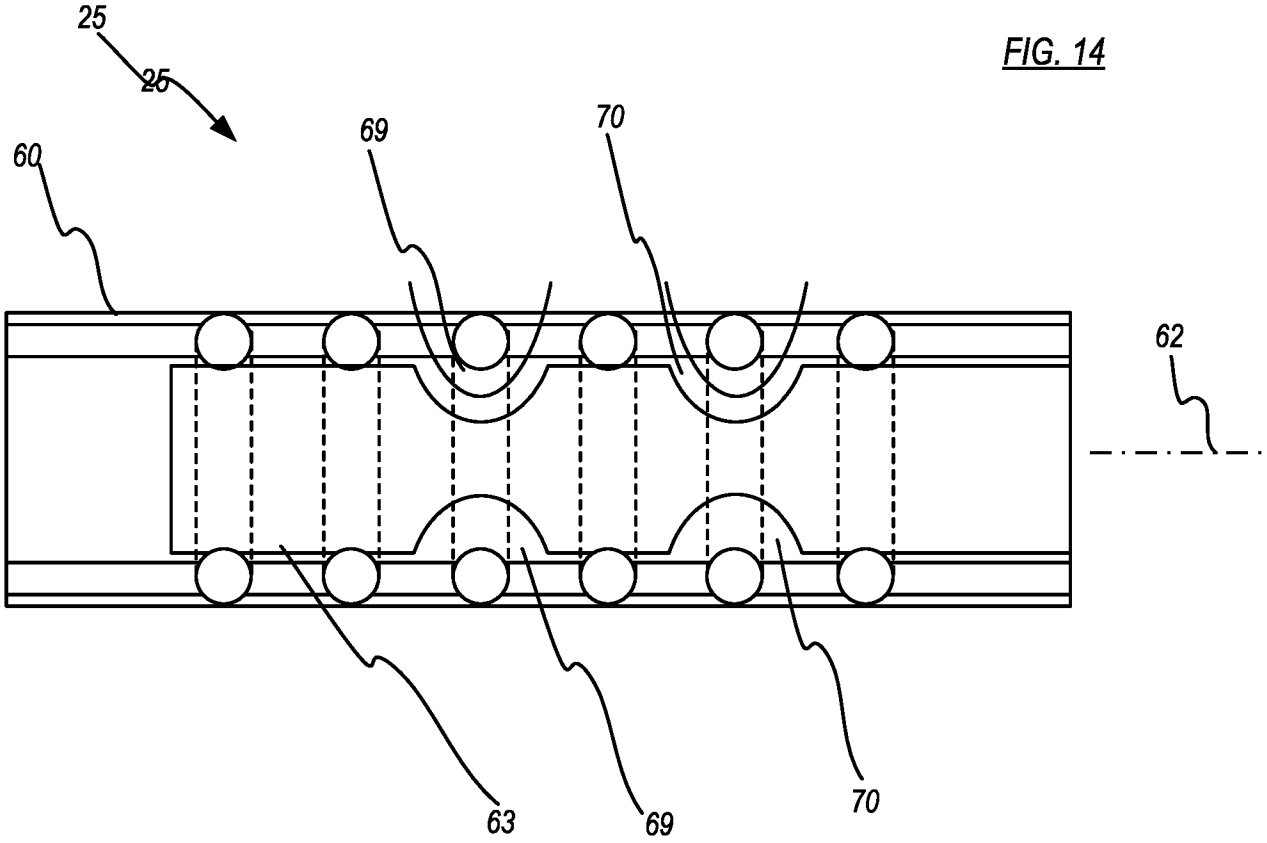
FIG. 14 is a schematic spool employed in the valve body of FIGS. 12 and 13.
Figure 15:
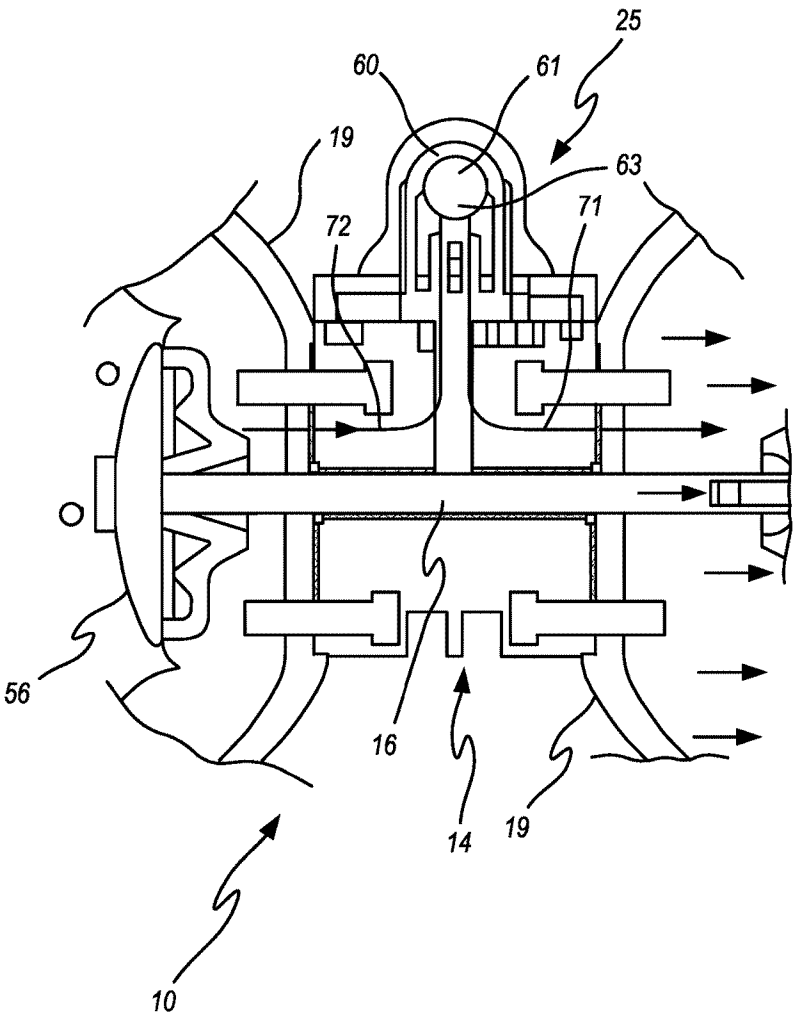

As best seen in FIG. 6, the segments 51 also extend angularly about the axis 18.

Each diaphragm 22 is integrally formed from the resiliency plastics material.

Preferably, each valve 30 and each diaphragm 22 is molded from resilient plastics material.

In operation of the above described pump 10 a working fluid under pressure is alternatively delivered to the first sub-chambers 23 by operation of a valve 25. This causes reciprocation of the piston assembly 14 thereby varying the volume of the sub-chambers 23 as well as the sub-chambers 24. A fluid being pumped is delivered to the inlet 26 wherefrom it flows to the sub-chambers 24 from the one-way valves 30. The fluid being pumped is drawn into each sub-chamber 24 as the volume thereof is being increased. As the volume of each sub-chamber 24 decreases the fluid being pumped is delivered to the outlet 27 again via the associated one-way valve 30.

The one-way valves 30 are located at an appropriate orientation to provide for flow in an inlet direction or an outlet direction depending on their location for the purposes of providing for fluid through the pump 10.

Each piston 15 includes a mounting flange 55 and an associated clamp plate 56 secured thereto so that the base 45 of the associated diaphragm is clamped between the associated mounting flange 55 and clamp plate 56.

The valve 25 is more fully understood with reference to FIGS. 10 to 14.

The valve 25 is a spool valve including a hollow body 60 providing a passage 61 having a longitudinal axis 62. Preferably, the axis 62 is generally horizontal. Slidably received in the passage 62 is a movable valve member in the form of a spool 63. The spool 63 is movable along the axis 62 between first positions at which compressed air is delivered to the first sub-chamber 23 to cause the pistons 15 to alternately undertake a pumping action. The spool 63 in further positions alternately connects the sub-chambers 23 with the exhaust.

Valve body 60 includes at least one delivery duct 64 that is connected to a supply of compressed air, and at least a first exhaust duct 65 and a second exhaust duct 66 that provides for the delivery of exhaust air from first sub-chambers 23. The duct 65 communicates a muffler 67 while the ducts 66 extend to exhaust openings 68 in the valve body 60 via which exhaust air is delivered directly to atmosphere, preferably via a disbursement grill to scatter the exhaust stream.

The spool 63 includes delivery passages 70 that connect the delivery duct/s 64 with a respective one of the sub-chambers 23 via a duct 71/72, and passages 69 that connect the other sub-chamber 23 with the exhaust passages 65 and 66 via a duct 71/72. Similar passages to the passages 70 are provided to connect the other sub-chamber 23 with the delivery duct/s 64 and the exhaust passages 65 and 66 again via the ducts 71 and 72.

The spool 63 is caused to reciprocate so as to provide for the delivery and exhaust of air with respect to the sub-chamber 23. This in turn causes reciprocation of the pistons 15. The spool 63 can be caused to reciprocate by the applications of axial forces to the spool 63 by air under delivered to the ends of the spool 63, or an actuator attached to the spool 63.

The above described preferred embodiment, with the above valve 25, provides the distinct advantage of reducing the resistance to air flow to atmosphere. Firstly air is delivered to the muffler 67, while a certain proportion of the exhaust air is delivered to the exhaust openings 68 direct to atmosphere. This significantly improves the efficiency of the pump 10.

Although the invention has been described with reference to specific examples, it will be appreciated by those skilled in the art that the invention may be embodied in many other forms.

The invention claimed is:

1. A pump having:

a pump body providing a first pump chamber;

a piston movably mounted in the body for reciprocation relative to the body; a diaphragm sealingly connecting the piston to the body so as to divide said chamber into a first sub-chamber and a second sub-chamber:

first ducting, said first ducting being in communication with said first sub-chamber to provide for the flow of a working fluid to and from said first sub-chamber to cause the reciprocation of said piston;

second ducting, said second ducting being in communication with said second sub-chamber to provide for the flow of a pumped fluid to and from said second sub-chamber;

a valve to provide for the delivery and exhaust of the working fluid with respect to the first sub-chamber, the valve including:

a valve body comprising a delivery duct, a first exhaust duct and a second exhaust duct, with the first exhaust duct and the second exhaust duct separately delivering exhaust working fluid to the atmosphere;

a movable valve element mounted in and movable with respect to the body to provide for the timed connection of the delivery duct with the first sub-chamber to deliver the working fluid thereto, and the timed connection of the first and second exhaust ducts with the first sub-chamber to duct the working fluid from the first sub-chamber, so that working fluid passes through both exhaust ducts simultaneously when working fluid is delivered to atmosphere;

further including a muffler through which the working fluid passes and to which the first exhaust duct is connected so as to deliver the working fluid to the muffler; and wherein the second exhaust duct extends to the exterior of the valve body wherefrom the working fluid is exhausted directly to atmosphere.

2. The pump of claim 1, wherein the valve is a spool valve, with the movable valve element being a spool, with the spool moved axially between a first position connecting the first sub-chamber to a supply of the working fluid under pressure, and a second position connecting the first sub-chamber with the first and second exhaust ducts.

3. The pump of claim 1, comprising a second pump chamber, the piston is a first piston, with the pump including a second piston, the second piston also being mounted in the body for reciprocation relative to the body in a direction opposite the first piston, the diaphragm is a first diaphragm, and the pump includes a second diaphragm sealingly connecting the second piston to the body so as to divide the second pump chamber into a third sub-chamber and a fourth sub-chamber; and wherein the pump further includes:

fourth ducting, the fourth ducting being in communication with the third sub-chamber to provide for the flow of pump fluid to and from the third sub-chamber, fifth ducting, the fifth ducting being in communication with the fourth sub-chamber to provide for the flow of the working fluid to and from the fourth sub-chamber to cause reciprocation of the second piston, with the valve providing for the delivery and exhaust of the working fluid with respect to the fourth sub-chamber, by the timed connection of the delivery duct to the fourth sub-chamber and the connection of the first and second exhaust ducts with the fourth sub-chamber.

4. The pump of claim 1, wherein the working fluid is air.

5. The pump of claim 2 comprising a second pump chamber, the piston is a first piston, with the pump including a second piston, the second piston also being mounted in the body for reciprocation relative to the body in a direction opposite the first piston, the diaphragm is a first diaphragm, and the pump includes a second diaphragm sealingly connecting the second piston to the body so as to divide the second pump chamber into a third sub-chamber and a fourth sub-chamber; and wherein the pump further includes:

fourth ducting, the fourth ducting being in communication with the third sub-chamber to provide for the flow of pump fluid to and from the third sub-chamber, fifth ducting, the fifth ducting being in communication with the fourth sub-chamber to provide for the flow of the working fluid to and from the fourth sub-chamber to cause reciprocation of the second piston, with the valve providing for the delivery and exhaust of the working fluid with respect to the fourth sub-chamber, by the timed connection of the delivery duct to the fourth sub-chamber and the connection of the first and second exhaust ducts with the fourth sub-chamber.

6. The pump of claim 2, wherein the working fluid is air.

7. The pump of claim 3, wherein the working fluid is air.

* * * * *